United States Patent [19]

Wales et al.

[11] Patent Number: 4,736,680

[45] Date of Patent: Apr. 12, 1988

[54] CLOSED LOOP REGISTER CONTROL

[75] Inventors: R. Langdon Wales, Lincoln; H. W. Crowley, Newton, both of Mass.

[73] Assignee: Web Printing Controls Co., Barrington, Ill.

[21] Appl. No.: 810,668

[22] Filed: Dec. 18, 1985

Related U.S. Application Data

[63] Continuation of Ser. No. 719,500, Apr. 4, 1985, abandoned, which is a continuation of Ser. No. 500,336, Jun. 2, 1983, abandoned.

[51] Int. Cl.[4] ..... B41F 5/06; B41F 13/12; B41F 33/16

[52] U.S. Cl. ..... 101/426; 101/181

[58] Field of Search ..... 101/181, 248, 183; 358/107, 199, 214, 283; 356/429, 444; 250/561, 559, 571

[56] References Cited

U.S. PATENT DOCUMENTS

| | | | |
|---|---|---|---|
| 3,339,817 | 9/1967 | French | 101/181 X |
| 4,232,336 | 11/1980 | Henry | 358/107 |
| 4,389,669 | 6/1983 | Epstein et al. | 358/107 |
| 4,428,287 | 1/1984 | Greiner | 101/248 X |
| 4,437,403 | 3/1984 | Greiner | 101/248 |

FOREIGN PATENT DOCUMENTS

| | | | |
|---|---|---|---|
| 2702274 | 1/1978 | Fed. Rep. of Germany | 101/181 |
| 7032924 | 4/1972 | France | 101/181 |

*Primary Examiner*—J. Reed Fisher

*Attorney, Agent, or Firm*—Welsh & Katz, Ltd.

[57] ABSTRACT

A closed loop register control system used in association with a printing press and comprising a television camera in combination with a strobe light and a solid state imaging device which enables continuous scanning of the sheet web. The apparatus of this invention also comprises a printing press console having associated therewith a digitizing tablet and a television monitor. The location of the area that is to be examined is defined by the pressman. The area to be examined may be selected by laying a proof sheet down on the digitizing tablet and recording the coordinates of the area of interest. This controls the camera and strobe light with the pressman selecting one part of the image as important and causing the register mechanism to maintain register in that selected area. Electronics then make comparisons between the detected image and a desired reference image to cause correction on a per color basis at the printing press stations.

9 Claims, 2 Drawing Sheets

CLOSED LOOP REGISTER CONTROL

This application is a continuation of application Ser. No. 719,500, filed Apr. 4, 1985, now abandoned, which in turn is a continuation of Ser. No. 500,336, filed June 2, 1983, now abandoned.

BACKGROUND OF THE INVENTION

The present invention relates in general to register control for multi-color printing and pertains, more particularly, to a closed-loop register control system used in conjunction with a commercial printing press.

There is tremendous interest in the printing industry in being able to automatically maintain register between printing cylinders of commercial printing presses. The problem comes about because colors are laid down separately by printing units which are spaced several feet apart. Therefore, the variations of the machinery, ink and paper are such that these individual color printing units have to be adjusted with relation to each other in order to register the colors on the sheet or web. In addition, throughout a printing run, there are upsets such as occur in, for example, splicing in of a new roll of paper or washing of the press unit, which cause short-term changes in the relative register between colors. There are also errors in the printing press preparation beginning with copy layout, through production of the plates, to the mounting of the plates. These errors are compensated for, on-press, by moving the plate image circumferentially and laterally so that all colors are registered as they are printed on the paper or other substrate.

In gravure printing automatic registration is standard. It is necessary to monitor the individual colors and adjust the cylinders. This adjustment usually takes place between each color unit and the next. Also, the dynamics on the stability of paper varies quite a bit.

There has been a long desire to apply the gravure printing techniques to commercial printing. It is noted that in commercial printing the register is generally more stable once it is running, but the initial obtaining of register can be quite wasteful and costly. The acceptance of the gravure techniques in commercial printing has been hampered by two major factors. First is the cost and second is the need to put registered targets on the printers image.

With respect to targets, in many types of commercial work there is a backbone or a clear area in the back of a magazine or a book where a target can be readily applied. However, it has been estimated that at least 50 percent of commercial work does not have non-printing areas which could be used to carry the target. One might contemplate providing an extra margin or area on the sheet. However, this adds extra cost. The ink and paper necessarily printed adds significantly to the cost. Furthermore, it detracts from the payback of close loop registers.

There are several installations known where the gravure technology of close loop register has been applied to commercial printing. The approach is to print individual targets at each press unit on to the paper and to monitor these targets with photoelectric eyes, controlling the mechanical register adjustments with respect to the position of the colors to the machinery.

There are several problems associated with the above mentioned approach:

1. The sheet-to-sheet register variation printed image is often as much as one row of dots thus causing a simple mark detector to see an appreciable amount of jitter.

2. The printed image does not always fit completely over all of the sheet. That is, the image may be correct in one area and be off in another. This problem of image fit can change dynamically with the moisture in the paper or the ink tack. The register target can be held in register and the image, several inches away, can be constantly changing register.

3. There is not always room to put the targets on the page.

4. The web may physically shift, mostly side to side, and any attempt to track the image by looking at its location with respect to the machinery, produces an error. The individual colored images may be correct but the entire web shifts.

5. Conditions that are mostly in need of register correction are often marginal with respect to contrast. That is, for instance, after a clean-up there may be a great deal of ink on the paper causing it to be rather dark. The other condition that can exist is where the contrast is very light due to momentary cleaning of the ink on the press. These are most critical for register, causing large register variations. However, they are also difficult for the simple photo detectors to resolve the printed mark.

Accordingly, it is an object of the present invention to provide an improved technique for overcoming the aforementioned problems.

Another object of the present invention is to provide an improved close loop register control technique that is substantially superior to prior techniques for obtaining and maintaining register on a printing press or other like process that forms patterns on a substrate.

SUMMARY OF THE INVENTION

To accomplish the foregoing and other objects of this invention there is provided a closed loop register control system used in association with a printing press or the like and comprising a television camera in combination with a strobe light and a solid state imaging device which enables continuous scanning of the sheet web. The television camera (receiver), imaging device and strobe light produce an effective time aperture. The apparatus of this invention also comprises a printing press console having associated therewith a digitizing tablet and a television monitor. The location of the area that is to be examined is defined by the pressman as being important to the specific job at that moment. The area to be examined may be defined by laying a proof sheet down on the digitizing tablet and recording the coordinates of the area of interest. This allows the pressmann to select one part of the image as important and causes the register mechanism to maintain register in that selected area.

BRIEF DESCRIPTION OF THE DRAWINGS

Numerous other objects, features and advantages of the invention should now become apparent upon the reading of the following detailed description taken in connection with the accompanying drawing, in which.

DETAILED DESCRIPTION

Figure 1:
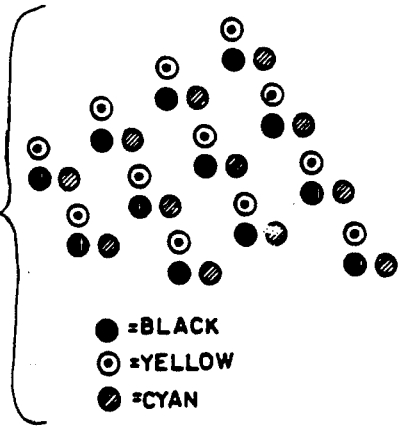
FIG. 1 illustrates a magnified viewed of a typical printed image shown in multiple colors.

FIG. 1 illustrates a magnified view of a typical printed image with the colors depicted in proper relative registry. The image is printed by a combination of multiple colors laid down separately. The example that has been selected shows three colors; black, yellow magenta and cyan printed with respect to each other. The printed image in this example is about 20 percent of a full solid and represents a typical density for flesh tones and many lightly colored objects.

As indicated previously, the density of the dots is shown magnified in FIG. 1. Typically, the density of the dots are 133 lines per inch or about 0.006 inch between centers. The dots are oriented at various angles with respect to the paper as noted in FIG. 1. This prevents the eye from detecting the patterns of the dots.

Figure 2:
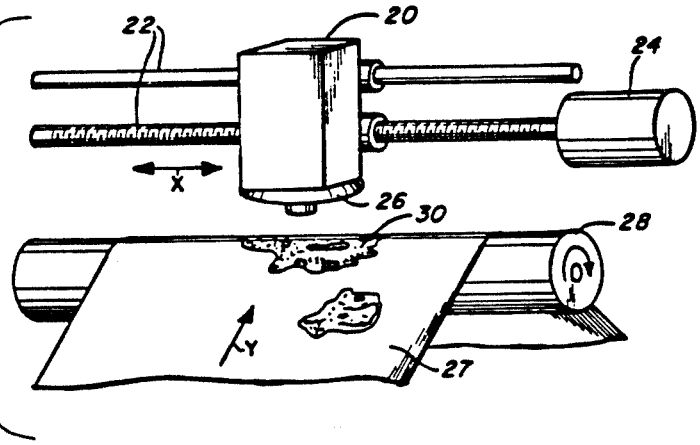
FIG. 2 is a perspective view showing a moving web and the associated television camera and strobe light.
Figure 3:
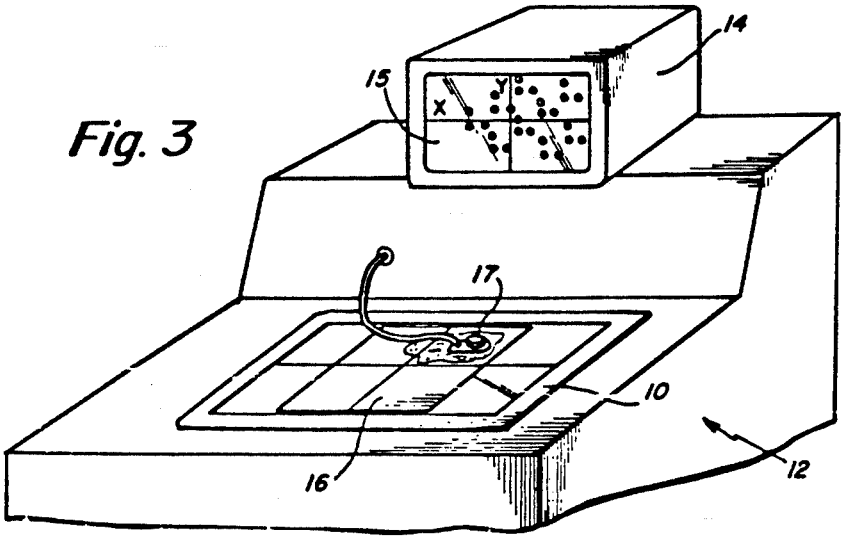
FIG. 3 shows a further part of the system of this invention including the printing press console, digitizing tablet, and television monitor.

The location of the area that is to be selected is defined by the pressman as an area that is important to the specific job being carried out at that moment. One approach to establishing this initial area of monitoring for register control involves the electronic digitizing tablet 10 which forms a part of the printing press console 12. FIG. 3 shows, in addition to the digitizing tablet 10, a television monitor 14. The tablet 10 and television monitor 14 may both be of conventional design. FIG. 3 also shows a sample or proof sheet 16 disposed on the electronic digitizing tablet 10 in correct registry with the tablet. One can then physically locate the area that is to be monitored. The area may be selected, for example, by a capacitive pen or probe 17. The coordinates of this area are then electronically transmitted to the positioning mechanisms associated with the television camera 20. In this regard reference may be made to FIG. 2 which shows, in addition to the television camera 20, the positioning mechanism which includes guide members 22 and motor 24. FIG. 2 also illustrates the strobe light 26 and the moving web 27 and associated roller 28. FIG. 2 shows the television camera 20 positioned over an image area 30 of the web 27. With regard to the set-up approach, concurrently with the transmission of the coordinates to position the television camera the image also appears locally on the television monitor 14 at the screen 15. The pressman thus has the ability to see quite readily exactly where the register is being monitored and to watch its performance, dynamically, throughout the run. The pressman can also move the image dynamically by watching the television screen and thus pick a slightly different point via the tablet to monitor for register variations before or after the run.

The use of a television camera mounted in proximity to the web as illustrated in FIG. 2 has many advantages. The actual image can be watched by the press operator on the screen 15 by comparing the relative positions of various colors with respect to each other. In the past the operator was required to make a visual comparison of a mark on the paper with respect to say an edge of the paper. With the use of a television camera the non-imaged area can be recorded so that the paper whiteness can be subtracted from the overall image to produce an electronically higher contrast. By the use of a color camera or a color scanning wheel the individual colors can be viewed separately by one sensor. In combination with the strobe light, the natural image storage techniques of television can be used to perform a great deal of analysis from a single sheet without having to build up an algorithm based upon continuous samples of successive sheets.

In accordance with the invention because the television camera is looking at an overall image (rather than a mark on the paper with respect to its location on the machinery) the camera can be more flexible in its location and its height above the paper, in order to capture the image. It can also have a longer field focus since the technique is to compare relative colors (color-to-color) rather than colors with respect to a fixed location.

Now, the method for electronically detecting the registration is to use the television camera to examine a pattern such as shown in FIG. 1 on a moving web with the aid of a strobe light. Again, reference is made to FIG. 2 which shows the moving web 27 along with the television camera and strobe light 26. The pressman then, via the tablet, controls the camera laterally or adjusts the time delay by means of strobe adjustment, to cause the image to move circumferentially until the pressman finds an area of similar percentage screen as to all colors as shown in FIG. 1. This is an area where all colors are showing.

A conventional solid-state imaging device with associated electronics then locates a black dot and then systematically scans the area about the dot to locate the yellow magenta and cyan dots (see FIG. 1). If the density of the screen is known and the screen angles are known then the precise centers of all dots can be predicted. The aforementioned electronics preferably includes computer or processor means of conventional design.

The purpose of the processor then is to compare the locations of the dots with their desired position and to establish X and Y that are lateral and circumferential corrections needed to bring the dots into correct register. The corrections are carried out at the printing press station for each respective color. These correction values are made only with respect to a reference color, in this case, the black dots. The corrections are simply the distance between the theoretical location and the electronically observed position.

Figure 4:
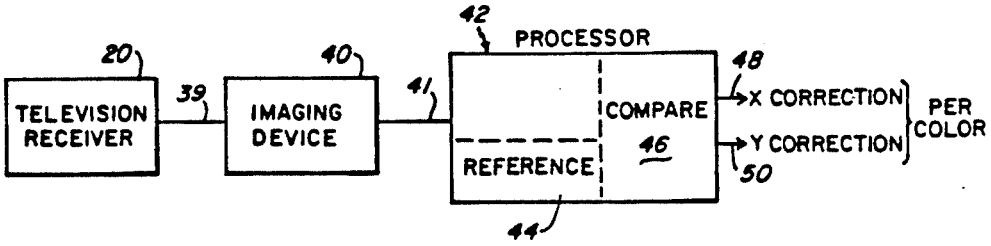
FIG. 4 shows a block diagram of the electronic control in accordance with the invention.

Reference is now also made to FIG. 4 which shows further details of some of the aforementioned portions of the electronic control. FIG. 4 shows the television receiver 20 with its output coupling by way of line 39 to the imaging device 40. The imaging device 40 may be of conventional design. The output of this device couples by way of line 41 to the processor 42. The processor 42 is shown schematically broken down into a referenced section 44 in a comparator section 46. As indicated previously, the purpose of the processor is to compare the locations of the dots as electronically represented from the imaging device 40, with a reference magnitude as stored in the reference block 44 of FIG. 4. As also indicated previously, there are correction signals on lines 48 and 50 referred to, respectfully, as an X correction and a Y correction. These correction values as indicated previously are made only with respect to a reference color such as black in the example given in FIG. 1.

Thus, the processor 42 looks at the location of a black dot as represented by some X and Y coordinate and compares this address with an address for say a cyan dot which is also digitally represented. If in making this comparison, it is determined that the dots are not in the desired position as established by reference 44, then the aforementioned correction signals are generated. These correction signals may be coupled to the printing press at each respective station for respective colors to provide for both lateral and circumferential corrections (as in connection with FIG. 2).

An important imperfection in the printing process is that the sheet-to-sheet or impression-to-impression register can vary. Therefore, the correction can only be on an averaged basis, that is, considering the results of several sheets and comparing it to the results of several sheets averages.

The theoretical alignment of the dots is only used during an initial start-up of the printing press. Usually due to the imperfections of the paper and the process, the image is not in register all over the impression. This lack of fit of the image requires the pressman to manually adjust register for the optimum only in certain areas; leaving other areas at less than perfect alignment. Therefore, after close examination and subsequent manual adjustments by the pressman the television camera can again scan the various colors with respect to the reference color and record their position as a standard. Subsequent changes from this standard can now be used as a correction signal to the printing units.

In order to locate a specific center of a specific color dot we can assume that the camera has a color separation filter before the lens, therefore, one color is a darker shade of gray than the others. In the standard color television tube, this information is also available. The circuitry then scans the area of the image, looking for the darkest shades of gray. Once the center point is located, the area around it is scanned to insure that there is enough other dark areas around it to be a dot and not just a speck. A minimum amount of grey area, all in a close region, means we have located a dot of ink.

To locate the center of the dot, we must locate the extremes in X and Y. To determine the widest point and the highest point, a further check is made on adjacent areas to ensure that they fall off very smoothly thus ensuring we have located a solid dot as opposed to an irregular shaped blemish.

What is claimed is:

1. A closed loop register control system for providing proper register in multi-color printing in connection with a moving web or sheet substrate having a multi-color image thereon adapted to pass a monitoring station, said system comprising, a television receiver at the monitoring station adapted to be positioned to view any segment of the multi-color image, means for positioning the television receiver including means for receiving a control signal to provide adjustment of the television receiver relative to the substrate to permit observation of any point of the multi-color image, means under operator control for generating a coordinate control signal for carrying out the adjustment, means for electronically storing a position signal corresponding to any reference color dot of the multi-color image as observed by the television receiver, means for electronically storing position signals corresponding to at least one other color dot observed by the television receiver, means establishing a predetermined desired interpositional signal, means for comparing the electronically observed relative position signals with the desired interpositional signal to determine if adjustment is necessary and means for providing automatic substrate position correction in the event of a correction signal being generated.

2. A closed loop register control system as set forth in claim 1 wherein said means for positioning the television receiver includes motor control means.

3. A closed loop register control system as set forth in claim 2 including strobe light means associated with the television receiver for providing an optical aperture.

4. A closed loop register control system as set forth in claim 3 wherein said means for generating a coordinate control signal includes a digitizing tablet.

5. A closed loop register control system as set forth in claim 4 including a sample or proof sheet associated with the digitizing tablet.

6. A closed loop register control system as set forth in claim 5 including a television monitor associated with the digitizing tablet.

7. A closed loop register control system for providing proper register in multi-color printing in connection with a moving web or sheet substrate having a multi-color image thereon adapted to pass a monitoring station, said system comprising, a television receiver at the monitoring station adapted to be positioned to view any segment of the substrate multi-color image, means for positioning the television receiver including means for receiving a control signal to provide adjustment of the television receiver relative to the substrate, means under operator control for generating a coordinate control signal for carrying out the adjustment, means for establishing and electronically storing a reference position for a reference series of dots from any series of dots comprising the image, means for electronically storing position signals corresponding to at least one other series of color dots and means for comparing the electronically stored relative position signals with desired interpositional signals to provide automatic substrate position corrections.

8. A method for providing a closed loop register control to in turn provide proper register in multi-color printing in connection with a moving web sheet substrate having a multi-color image thereon, said method comprising the steps of providing a television receiver, under operator control positioning the television receiver so as to view a desired segment of the substrate, electronically storing a position signal corresponding to any reference color dot in the multi-color image, electronically storing a position signal corresponding to at least one other color dot, establishing a predetermined desired interpositional signal, and comparing the electronically stored relative position signals with the desired interpositional signal to determine if adjustment is necessary and providing automatic substrate position correction in the event of a correction signal being generated.

9. A method for providing a closed loop register control to provide proper register in multi-color printing in connection with a moving web sheet substrate having a multi-color image thereon, said method comprising the steps of, providing a television receiver at a monitoring station, disposing said television receiver in a position to view any segment of the substrate multi-color image, providing a control signal, adjusting the television receiver in accordance with the control signal so as to adjust the receiver relative to the substrate, generating a coordinate control signal, for carrying out the adjustment, electronically storing a position signal corresponding to a reference color dot from any segment of the multi-color image, electronically storing position signals corresponding to at least one other color dot, establishing a predetermined desired interpositional signal, comparing the electronically stored relative position signals with the desired interpositional signal, determining if adjustment is necessary, and providing an automatic substrate position correction in the event of a correction signal being generated.

* * * * *